United States Patent [19]

Ritter et al.

[11] 4,019,665

[45] Apr. 26, 1977

[54] FEED DEVICE FOR ROD OR STRIPLIKE MATERIAL

[75] Inventors: Klaus Ritter; Hans Gott; Gerhard Ritter; Josef Ritter, all of Graz, Austria

[73] Assignee: Firma Evg Entwicklungs-u Verwertungsgesellschaft, Graz, Austria

[22] Filed: Dec. 19, 1975

[21] Appl. No.: 642,387

[30] Foreign Application Priority Data

Dec. 20, 1974 Austria ..... 10211/74

[52] U.S. Cl. ..... 226/112; 226/182; 226/188

[51] Int. Cl.[2] ..... B65H 51/18

[58] Field of Search ..... 226/112, 108, 115, 168, 226/188, 120, 182, 117

[56] References Cited

UNITED STATES PATENTS

| | | | |
|---|---|---|---|
| 789,060 | 5/1905 | Pickering | 226/108 X |
| 2,389,556 | 11/1945 | Siegerist | 226/112 X |
| 3,635,441 | 1/1972 | Haines | 226/188 X |

*Primary Examiner*—Evon C. Blunk
*Assistant Examiner*—Bruce H. Stoner, Jr.
*Attorney, Agent, or Firm*—Ernest F. Marmorek

[57] ABSTRACT

The invention concerns a feed device for feeding rod or striplike material, the device having two or more feed members which are arranged to lie behind one another along a feed path of the material. Each of the feed members carries a plurality of grippers arranged at equal angular intervals around a central axis of the feed member and is connected with a gearing which imposes on the feed member a rotational motion about its axis and, simultaneously, a circular motion about a fixed axis parallel with its own axis. The arrangement is such that said rotational and circular motions are coordinated so that the grippers of each of said feed members describe a trochoidal path which includes a substantially straight-line section along the feed path. Devices are provided for the automatic actuation of the grippers during their sweep through the straight-line section and the motion of the two feed members is coordinated so that the grippers of one feed member engage the material alternately with the grippers of the other feed member with an overlap in time to provide continuous advancement of the material.

7 Claims, 7 Drawing Figures

FEED DEVICE FOR ROD OR STRIPLIKE MATERIAL

Various ways are known of feeding rod-or striplike material forwards in its longitudinal direction. For example, it is known for this purpose, to grip the rod or striplike material between cooperating driven friction-rollers. With this kind of material feed there is the disadvantage that between the friction-rollers and the material to be fed a rolling friction prevails, which only enables transmission of relatively small forces between the material to be fed forward and these driving friction-rollers. A further disadvantage ies in the very small contact surface between the material to be fed forward and the friction rollers, so that the forces that can be transmitted are still further very severely limited. Contact can in fact be effected continuously only along a line or even only at a point.

In order to avoid the described disadvantages of friction-rollers, other known feed devices employ systems of clamp-shoes fitted together in the manner of caterpillar tracks. Devices of that kind allow contact surfaces to be formed of any size, and moreover there prevails between the clampshoes and the material to be fed forward static friction. The play necessary between adjacent links of chains of that kind and the relatively large number of links necessary, however, make accurate guidance the chains difficult especially when high feed rates are to be achieved.

The present invention is concerned with the problem of creating a feed device for strip-or rodlike material, which on the one hand allows the transmission of large forces to the material to be fed forward and on the other hand also enables high feed rates to be reached.

A feed device for rod-or striplike material, which solves this problem, and which is in accordance with the present invention, comprises two or more feed members arranged to lie one behind the other along a feed path of the material, each of the feed members carrying a plurality of grippers lying at equal angular intervals around a central axis of the feed member and being connected with a gearing which imposes upon the feed member a rotational motion about its axis and, simultaneously, a circular motion about a fixed axis parallel with its own axis, the arrangement being such that the rotational and circular motions are coordinated so that the grippers of each feed member describe a trochoidal path which includes a substantially straight-line section along the feed path, devices being provided for automatic actuation of the grippers during their sweep through the straight-line section, and the rotational and circular motions of the two feed members being coordinated so that the grippers of the two feed members engage the material alternately with an overlap in time.

Preferably, each feed member has the shape substantially of an equilateral polygonal disc and includes a circumferential groove for receiving the material which is to be fed forwards, the grippers lying on either side of the plane of this groove.

The grippers may be slidable into the groove in the manner of plungers mounted in recesses in the feed members.

Four examples of a feed device according to the invention will now be described with reference to the accompanying drawings in which.

Figure 1:
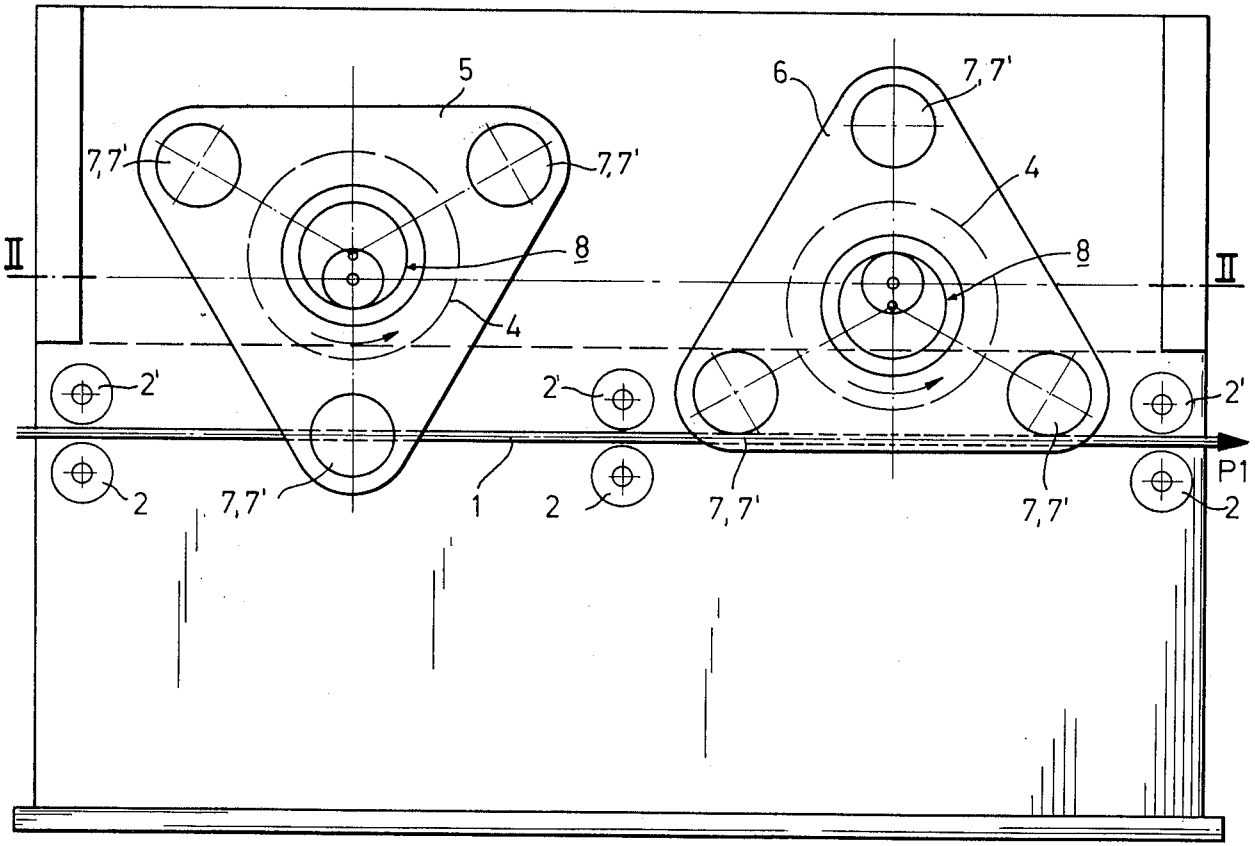
FIG. 1 shows an elevation of a first feed device in accordance with the invention.

In order, for example, (see FIG. 1) to feed forward a wire 1 which is to be conveyed in the direction of the arrow P1 and guided between pairs of guide-rolls 2,3', two triangular rotors 5, 6 are provided as feed members.

Each rotor has, along its circumference, a groove 3 (see FIG. 2) of U-shaped cross-section having a bottom 4 concentric with the centre of the rotor, so that it can embrace the wire 1. At each of the three corners of the rotor are provided two cooperating grip-members 7,7' for seizing the wire 1. By gearing designated in general by reference numeral 8 the rotors 5, 6 are set in rotational and circular motions such that each of its grip-members gets moved along a trochoidal path which has a section of the path which is straight to a close approximation and which runs along the axis of the wire 1. Furthermore, the two rotors 5, 6 are coupled together in synchronous motion in such a way that their grip-members 7, 7' come into use alternately and with an overlap in time so that continuous feed of the wire 1 is ensured.

Figure 2:
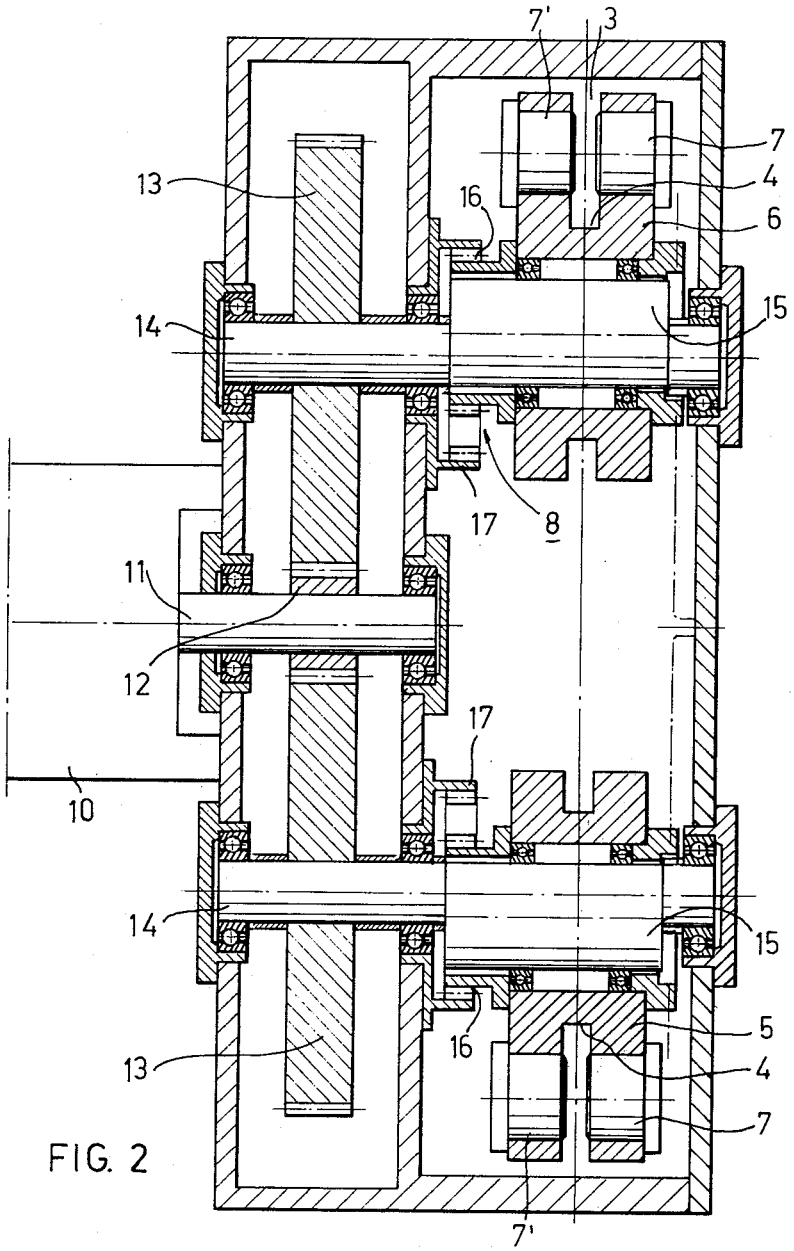
FIG. 2 shows a section along the line II—II in FIG. 1.

A typical driving mechanism for the rotors 5, 6 is shown in FIG. 2. A driving motor 10 shown only diagrammatically drives a shaft 11 on which is fixed for rotation a pinion 12. On opposite sides of the pinion are positioned gearwheels 13 which mesh with the pinion 12.

Each gearwheel 13 is connected for rotation to a shaft 14 which carries an eccentric 15.

The eccentrics 15 pass through bores in the rotors 5, 6 and are supported rotatably with respsect to these rotors, e.g., as indicated in the drawing, by means of ball bearings. Each rotor 5, 6 is connected rigidly to a gear rim 16 which meshes with a gear rim 17 connected rigidly to the machine housing. By this arrangement a compound motion is imparted to the rotors 5, 6 in which each rotor 5, 6 turns about its own axis coinciding with the axis of the eccentric 15 and this axis at the same time moves on a circular orbit about the axis of the shaft 14.

Figure 3:
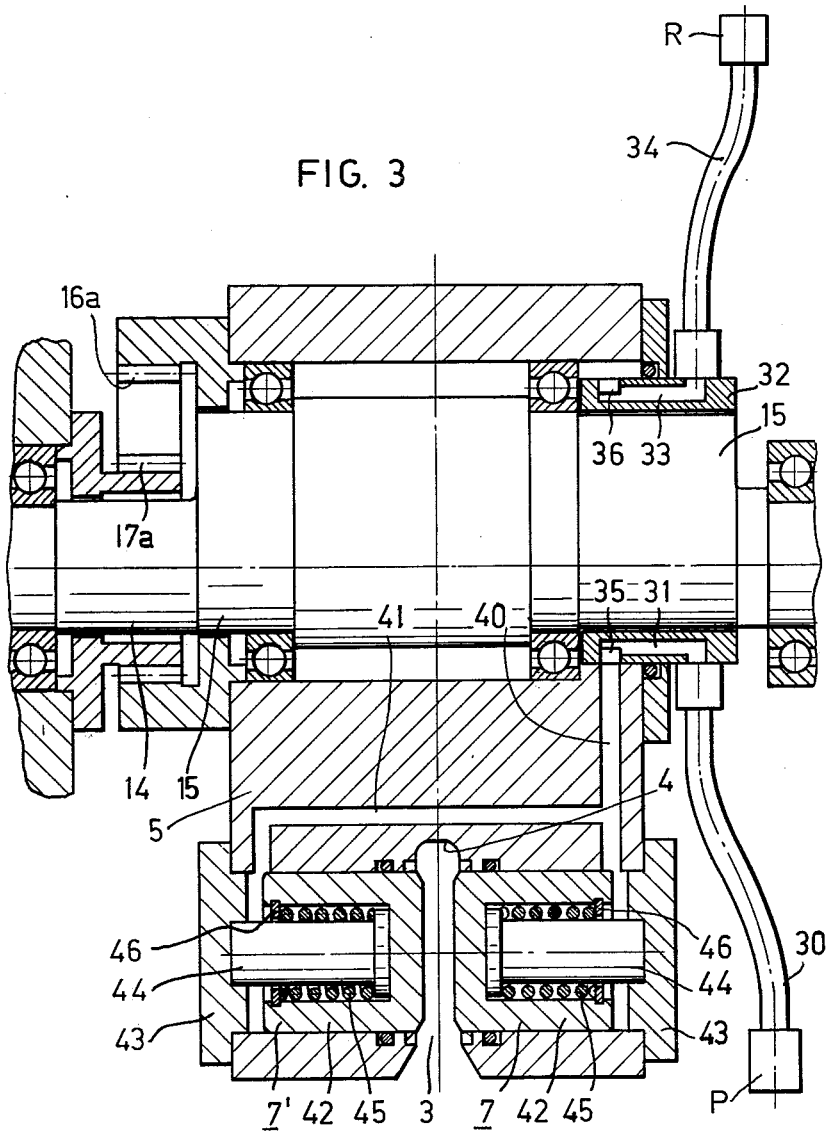
FIG. 3 shows an axial section through the feed member of a second device having an altered gearing and a hydraulic actuator for the grippers.
Figure 4:
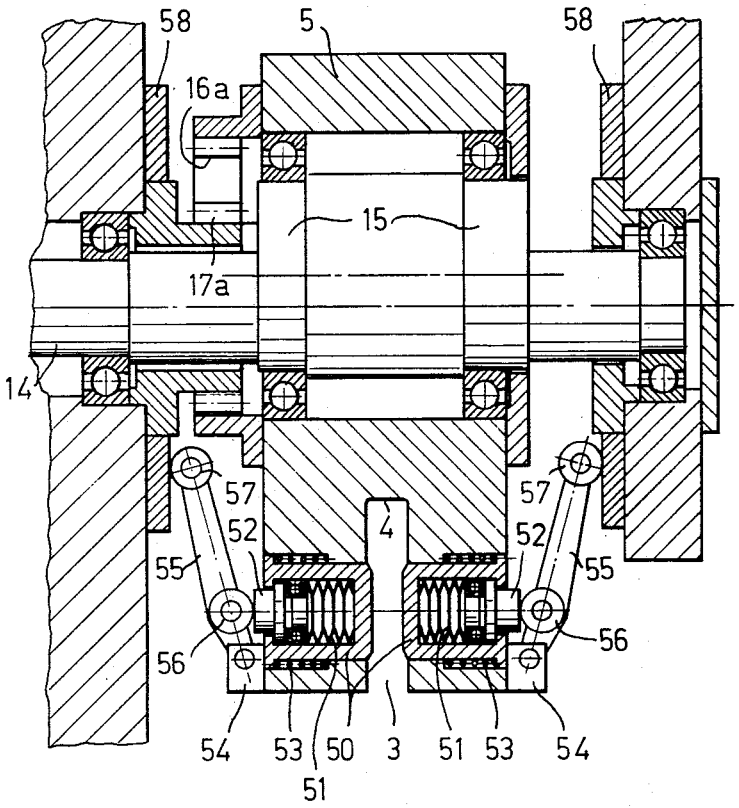
FIGS. 4 and 5 show an axial section and an elevation respectively of the feed member of a third device, in which a mechanical actuator for the grippers is provided; and, FIGS. 6 and 7 show an elevation and a partial section through the feed member of a fourth embodiment in which, likewise, mechanical gripper-actuation is provided.

In that case, it is of no significance to the essence of the invention whether the stationary gear rim 17 connected to the machine housing has a larger diameter and internal teeth and the gear rim 16 connected to the rotor a smaller diameter and external teeth as is shown in FIG. 2 or whether the arrangement is reversed as in the case of the gearwheels **16*a* and 17*a* in FIGS. 3 and 4.**

FIGS. 3 to 7 show different possibilities for actuation of the grip-members 7, 7'.

In every case the grip-members are so formed that they can turn relative to the rotor carrying them, so that during the time during which the grip-members are in engagement with the wire no bending moment can be transmitted from the turning rotor via the grip-members to the wire.

FIG. 3 shows, by way of example, hydraulically actuable grip-members 7, 7'. A pump P conveys a pressure medium via a flexible pipe 30 into the bore 31 of an annular body 32 surrounding the eccentric 15. This annular body 32 is held by a supporting device, which is not illustrated because it is know, in such a way that it can perform a motion of translation about the axis of the shaft 14 but cannot turn. A further bore 33 in the annular body 32 is connected to a flexible pipe 34 which leads to the return R for the pressure medium.

Along the circumference of the annular body 32 two ring sector grooves 35 and 36 are so arranged that the ring sector groove 35 that serves for feeding the pressure medium to the grip-members 7, 7' extends over a zone of the circumference that corresponds with the travel over which the grip-member engages with the wire 1. Separated from the ring sector groove 35 by a portion, the ring sector groove 36 that serves for the return of the pressure medium extends round the remaining zone of the circumference of the annular body 32.

Bores 40 and 41 are machined in the body of the rotor 5 to provide a connection between the ring sector grooves 35 and 36 respectively and the grippers 7, 7'.

The actual grip-members each consist of a hollow cylinder 42, with a coverplate 43 closing the opening in the body of the rotor 5, 6 into which the grip-members are inserted. A mushroom-shaped insert 44 is fastened rigidly into the coverplate 43 and projects inside the hollow cylinder 42 into the bore, the wider end of the insert 44 being fitted within the bore. Between the wider end of the insert 44 and a circlip 46 arranged inside the hollow cylinder 42, a spring 45 is inserted having the tendency to pull the hollow cylinder 42 back to a stop against the wider end of the insert 44.

It is to be recommended that a protective coating (not shown) be applied to the bottom face of the hollow cylinder 42, which seizes the wires to be conveyed, which on the one hand should be wear-resistant, especially abrasion-resistant, and on the other hand be compressible in order to ensure the fullest possible embrace of the wires. Such coatings are well known.

As soon as the gearing 8 sets the rotor 5 in motion the rotor 5 performs a rotational motion relative to the body 32. The bore 40 then passes alternatively over the ring sector grooves 35 and 36 whereby a connection is provided first of all to the flexible pipe 30 and the pump P and then to the flexible pipe 34 and the return R. As soon as the connection to the pump is produced, pressure medium is conveyed into the annular gap between the cover-plate 43 and the hollow cylinder 42, whereby the hollow cylinder 42 acting as a plunger gets forced towards the wire to be fed forward (not shown in FIG. 3). On connection with the return R the pressure behind the hollow cylinder 42 is reduced and the spring 45 brings the hollow cylinder 42 back into the rest position, freeing the wire.

Figure 5:
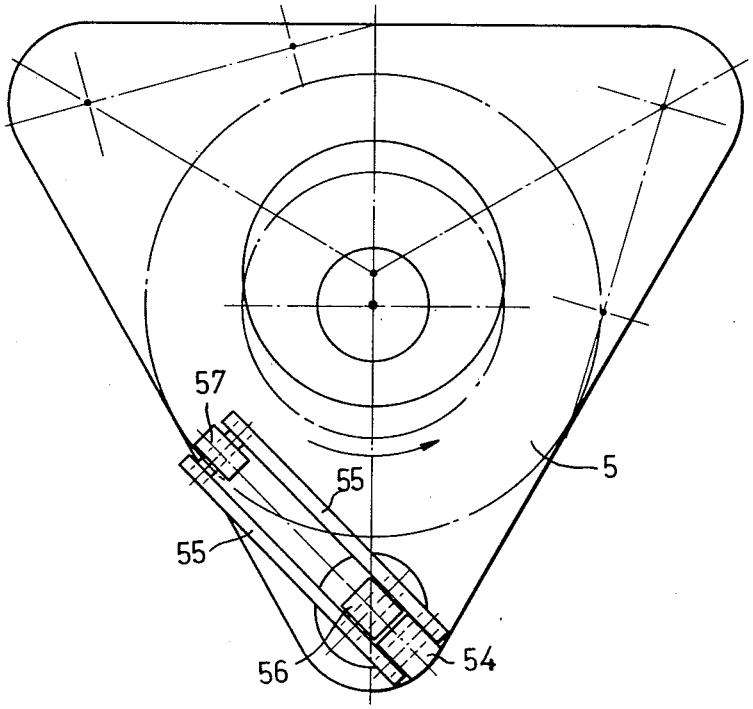

FIGS. 4 and 5 show a mechanical actuator for the grippers, 7, 7'. The grip-members again consist of a hollow cylinder 50 inside which is fitted a strong spring 51 composed of a number of cup-springs. This spring 51 can be compressed by pushrods 52, and between the pushrod and the spring 51 a ball bearing can be seen which has the purpose of ensuring easy rotatibility of the grippers with respect to the rotor 5 even with heavy loading of the spring. A weaker spring 53 surrounding the hollow cylinder 50, which bears at one end against an edge flange on the hollow cylinder 50 and at the other end against an annular shoulder on the rotor 5, is used for return of the hollow cylinder 50 into its rest position.

In an abutment 54 arranged on the rotor 5 a simple lever 55 is rotatably supported which carries two rollers 56 and 57. The rollers 56 are used for actuating the pushrod 52, while the roller 57 is a pick-up roller which follows a camtrack 58 fitted to the machine housing. The camtrack 58 is so formed that the levers 55 move the hollow cylinders 50 together as soon as they lie in the zone of engagement with the wire. In that case the spring 53 is first of all compressed until the bottom faces of the hollow cylinders seize the wire, and only then is the spring 51 compressed.

Obviously in the case of this embodiment too, just as in the next, identical driving mechanisms are provided at all three corners of the rotor 5, although in the elevations for the sake of simplicity only one driving mechanism is ever completely detailed.

Figure 6:
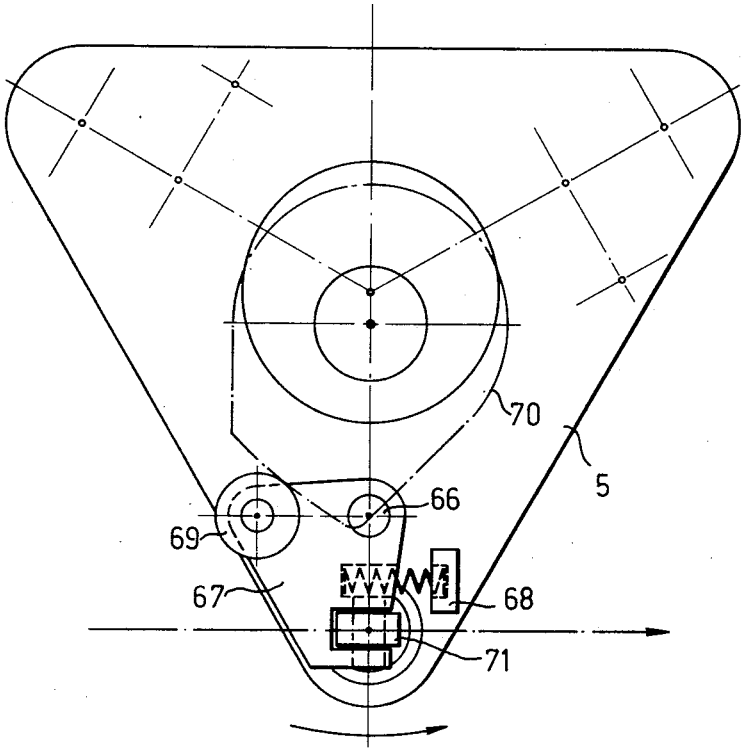
Figure 7:
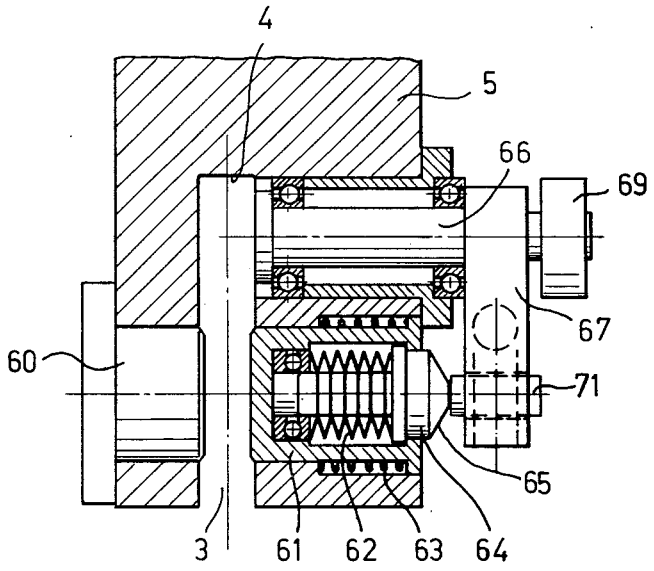

Another possible embodiment for mechanical actuation of the grippers is illustrated in FIGS. 6 and 7. In this case the rotor 5 carries on the one side of the recess of U-shaped cross-section, which embraces the wire, a fixed abutment 60. Opposite the abutment a movable hollow-cylindrical gripper 61 is provided, which like the embodiment as FIGS. 4 and 5, is equipped with a strong spring 62 composed of a number of cup-springs and a return spring 63. Easy rotatability of the hollow cylinder with respect to the pressure mechanism is again ensured by a ball bearing which is merely indicated.

The pushrod 64 has at the outer end the shape of a cone 65. On a shaft 66 supported undisplaceably but rotatably in the rotor 5 a bell-crank 67 in the form of a triangular disc is supported. The bellcrank 67 by a spring bearing against a stop 68 is forced with its pick-up roller 69 arranged at one corner, against a cam-disc 70 arranged fixed to the machine.

An actuator roller 71 via the cone 65 forces the pushrod 64 inwards and hence brings the gripper 61 into contact with the wire to be fed forward, as soon as the pick-up roller 69 runs up an appropriately shaped section of the cam-disc.

The examples described do not exhaust the possibilities of execution of the invention. Thus actuation of the grippers into their position gripping the wire may be effected, for example, also electromagnetically.

With striplike material, say with sheetmetal strips, synchronized feed devices may be arranged at both opposite edges of the striplike material, in which case the separation between these feed devices is preferably made adjustable for the purpose of adaptation to the width of the striplike material to be fed forward.

We claim:

1. A feed device for rod- or strip-like material, comprising, in combination:

a housing:

at least two feed members each having a central axis and being longitudinally spaced apart from each other to define a feed path for said material;

a plurality of gripping means disposed on each of said feed members about its central axis and each of said gripping means being operable for engaging and moving said material along said feed path;

driving means disposed in said housing and operable for rotating each of said feed members around its central axis and simultaneously, around a fixed axis parallel to the respective central axis;

the rotation of each of said feed members moving each of said gripping means along a trochoidal path including a substantially straight portion substantially along said feed path;

said gripping means being operable for moving said material along at least a part of said straight portion;

said driving means rotating said feed members so that said gripping means of one and the other of said feed members alternately engage said material with an overlap in the respective periods of time engagement.

2. The device as claimed in claim 1, wherein said driving means includes for each of said feed members a rotatable drive shaft including an eccentric portion rotatably coupled to the feed member and journalled for rotating the feed member thereabout, an internally toothed gearwheel fixed to said housing and coaxial with said driving shaft, an externally toothed gearwheel in meshing engagement with said internally toothed gearwheel and coaxial with the central axis of the feed member.

3. The device as claimed in claim 1, wherein said driving means for each of said feed members includes a rotatable drive shaft including an eccentric portion and rotatably coupled to the feed member for rotating the feed member thereabout, an externally toothed gearwheel connected to said housing and coaxial with said driving shaft, an internally toothed gearwheel in meshing engagement with said externally toothed gearwheel and coaxial with the central axis of the feed member.

4. The device as claimed in claim 3, wherein each of said rotatable drive shafts includes a gearwheel and said driving means further includes a common drive gearwheel in meshing engagment with each said rotatable drive shaft gearwheel.

5. The device as claimed in claim 1, wherein each of said feed members has a substantially equilateral polygonal shape, each of said feed members including a circumferential groove shaped to receive said material and for carrying one of said gripping means.

6. The device as claimed in claim 5, wherein each of said feed members has a substantially triangular shape.

7. The device as claimed in claim 5, wherein each of said gripping means is in sliding engagement with the respective grooves, said gripping means each forming plungers mounted in recesses defined in said feed members.

* * * * *